United States Patent [19]

Dillman

[11] 4,360,035

[45] Nov. 23, 1982

[54] LAWN UMBRELLA

[75] Inventor: Thomas P. Dillman, Spring City, Tenn.

[73] Assignee: The Sherwood Corporation, Spring City, Tenn.

[21] Appl. No.: 295,807

[22] Filed: Aug. 24, 1981

[51] Int. Cl.[3] ..... A45B 11/00; A45B 19/00

[52] U.S. Cl. ..... 135/20 R; 135/25 A

[58] Field of Search ..... 135/20 R, 21, 25 R, 135/26, 29, 31, 25 A; 244/153 R; D3/5

[56] References Cited

U.S. PATENT DOCUMENTS

| | | | |
|---|---|---|---|
| 973,406 | 10/1910 | Clark | 135/25 A |
| 1,613,287 | 1/1927 | Moser | 135/26 |
| 2,871,868 | 2/1959 | Faasse | 135/20 R |
| 3,252,469 | 5/1966 | Peake | 135/20 R |
| 4,007,753 | 2/1977 | DeMarco | 135/25 A X |

*Primary Examiner*—Harland S. Skogquist
*Attorney, Agent, or Firm*—Alan Ruderman

[57] ABSTRACT

A lawn umbrella having a shade of a rectangular configuration supported by four ribs, the free end of each rib being received in a pouch at a respective corner of the shade. The other ends of two of the ribs are pivotably connected to a collar slidable on the mast, the collar being lockable in operative position by a thumb screw. The other ends of the other ribs are pivotably connected to the top of the mast. A pair of struts are pivotably connected at one end to the second mentioned ribs and at the other end to a second slidable collar. Another pair of struts are pivotably connected at one end to the mast and at their other ends to the respective first mentioned ribs.

6 Claims, 3 Drawing Figures

LAWN UMBRELLA

BACKGROUND OF THE INVENTION

This invention relates to umbrellas or sunshades and more particularly to an outdoor umbrella of the stationary type generally known as lawn umbrellas, the umbrella shade having a non-circular periphery and being readily collapsible.

In co-pending U.S. patent application Ser. No. 266,459 filed May 22, 1981, a lawn umbrella having a substantially quadrilateral shade configuration is disclosed which is readily adjustable to change inclination by tilting the shade. That umbrella includes a pair of ribs extending between respective opposed corners of the shade, one of which ribs contacts the shade surface and is slidable within a sleeve at the top of the mast and the other of which is slidable within a sleeve mounted at a lower position on the mast. With this arrangement the shade is not collapsible except by disassembly of the ribs from the mast, and although despite weather conditions rapid collapsibility may not normally be required, there are instances where collapsing of the shade is desirable, such as during a violent rain and wind storm.

SUMMARY OF THE INVENTION

Consequently, it is a primary object of the present invention to provide a lawn umbrella having a readily collapsible non-circular shade.

It is another object of the present invention to provide a lawn umbrella having a shade of the quadrilateral configuration that can be quickly opened and closed.

It is a further object of the present invention to provide a lawn umbrella having an aesthetic quadrilateral shaped shade supported by ribs at each corner from a vertical mast and readily collapsible relatively to the mast.

The present invention provides a readily collapsible lawn umbrella, the umbrella preferrably having a quadrilateral shaped shade in the form illustrated in the aforesaid co-pending patent application. Bowed ribs are provided so that the shade surface between two opposed corners is bowed downwardly to have the center of curvature beneath a shade and the shade surface between the other two corners bowed upwardly to have the center of curvature above the shade. To collapse the shade articulating mechanism is provided which pivots the outer ends of the downwardly bowed ribs inwardly toward the mast about the inner ends while lowering the inner ends of the upwardly bowed ribs and swinging the outer ends inwardly toward the mast.

To this end the inner ends of the downwardly bowed ribs are pivotably carried by the upper portion of the mast and the inner ends of the upwardly bowed ribs are pivotably carried by a slider journalled on the mast, the slide having means for securing it to the mast in the open shade position. For additional support and guidance the upwardly bowed ribs are each pivotably connected to a strut that is hinged to the mast intermediate the slider and the inner ends of the downwardly bowed ribs, and each of the downwardly bowed ribs is pivotably connected to a strut that is hinged to a second slider disposed about the mast above the first slider. The two sliders lower together until just prior to the completely collapsed position at which time they separate as the first slider further lowers.

BRIEF DESCRIPTION OF THE DRAWINGS

The particular features and advantages of the invention as well as other objects will become apparant from the following description taken in connection with the accompanying drawings, in which.

DESCRIPTION OF THE PREFERRED EMBODIMENT

Figure 1:
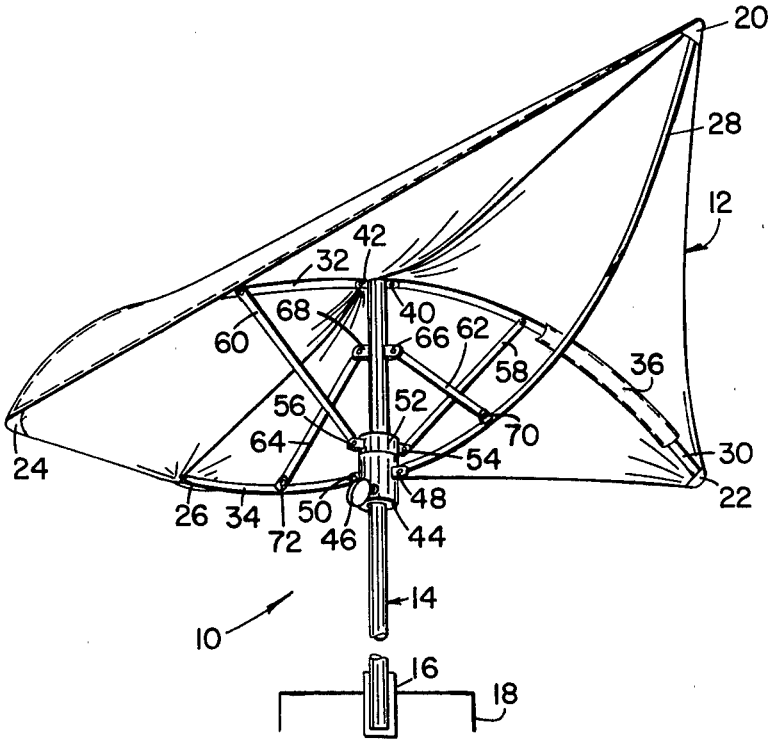
FIG. 1 is a perspective view of a lawn umbrella in the fully open position constructed in accordance with the principles of the present invention.
Figure 2:
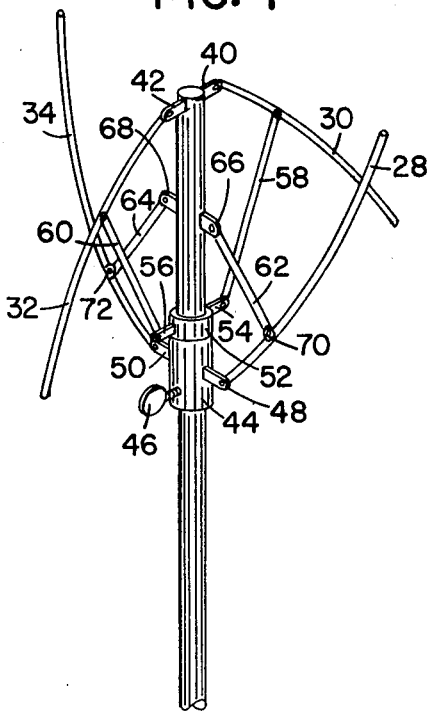
FIG. 2 is a perspective view of the umbrella of FIG. 1 partially collapsed and with the shade removed for clarity.

Referring now to the drawings, a lawn umbrella constructed in accordance with the present invention is illustrated at 10 and generally comprises a shade 12 mounted on the end of a mast 14 as hereinafter described, the mast conventionally being rotatably received within a sleeve type receptical 16 secured to a stable support structure such as a table 18 or the like or with a sleeve in the ground. The shade 12 of the umbrella of the present invention, which is similar to that disclosed in the aforesaid patent application, is a relatively thin fabric or similar covering such as nylon or other suitable material. Preferrably the peripheral edge configuration of the shade is square, but most if not any quadrilateral shape would function suitably, as will hereinafter be understood from this description. The shade may be constructed from a single piece of material or may be assembled by seaming a number of sectors together, and the edges of each side may be strengthened by seams or welts.

At each corner of the shade is a small respective pouch or pocket 20, 22, 24, 26 secured to the shade at the periphery of the corner having an open edge facing toward the central portion of the cover. The pouches may be triangular pieces of fabric seamed to the corners of the shade, one apex of the pouch and the adjacent edges being attached to the corner of the shade. Each of the pouches 20, 22, 24, 26 is adapted to receive the end of a respective bowed rib 28, 30, 32, 34, the ribs 28 and 34 being bowed upwardly so that the centers of curvature are above the shade and the ribs 30 and 32 being bowed downwardly so that their centers of curvature are below the shade. Intermediate the central section of the shade and each of the pouches 22 and 24 may be a sleeve 36 (only one of which is illustrated) formed by sewing or otherwise attaching a piece of fabric to the cover material, each sleeve 36 being adapted for slidably receiving the pouch receiving end of the respective ribs 30 and 32.

At or adjacent the upper most end of the mast 14 the other end of each of the downwardly bowed ribs 30 and 32 is hingedly connected to a respective ear 40, 42 secured at opposed dispositions on the mast so that each rib 30, 32 can pivot relatively to the mast. Positioned about the mast below the ears 40, 42 is a slider 44 comprising a substantially cylindrical sleeve freely slidable relatively to the mast. The slider 44 includes a tapped hole into which a thumb screw 46 or the like is threaded, the threaded end of the thumb screw acting on the mast when tightly threaded into the slider to secure the slider on the mast at selected locations as required and for reasons which will hereafter become apparent. Secured to the slider 44 at opposed dispositions are a pair of ears 48, 50, the other end of each of the upwardly bowed ribs 28 and 34 being hingedly connected to one of the ears 48, 50.

With the ribs positioned within the respective pouch, raising the slider will raise the shade at the corners containing the pouches 20 and 24 while the downwardly bowed hinged ribs 30 and 32 will lift the other corners due to the tension on the shade. This, however, would not be totally satisfactory since under normal wind conditions the shade would flap in the breeze. Consequently, to provide a more structurally sound construction and to provide for a more positive and effective raising and lowering of the shade, the present invention also provides a second slider 52, which as illustrated may be a smaller cylindrical sleeve freely slidble on the mast 14 and disposed above the slider 44, the slider 52 resting on and supported by the slider 44 in the open shade position. Secured to the slider 52 at opposed dispositions are a pair of ears 54, 56 to which one end of a respective strut 58, 60 is hingedly connected. The other end of each of the struts 58, 60 is hingedly connected to one of the downwardly bowed ribs 30, 32 at a disposition between the respective ear 40, 42 and the fabric sleeve 36. Thus, the strut 58 is pivotably connected to the rib 30 while the strut 60 is pivotably connected to the rib 32. To further add rigidity to the structure and to aid in opening and closing the shade and further to prevent the free ends of the ribs 28 and 34 from falling when the shade is removed for cleaning or storage and the like, a respective strut 62 and 64 is hingedly connected at one end to a respective ear 66, 68 secured on the mast, and at its other end is hinged to the respective rib 28, 34 at a lug 70, 72. The location of the ears 66, 68 are above the respective lugs 70, 72 to aid the slider 44 in supporting the ribs 28, 34 and to allow the slider to lower to the closed or collapsed shade position.

Figure 3:
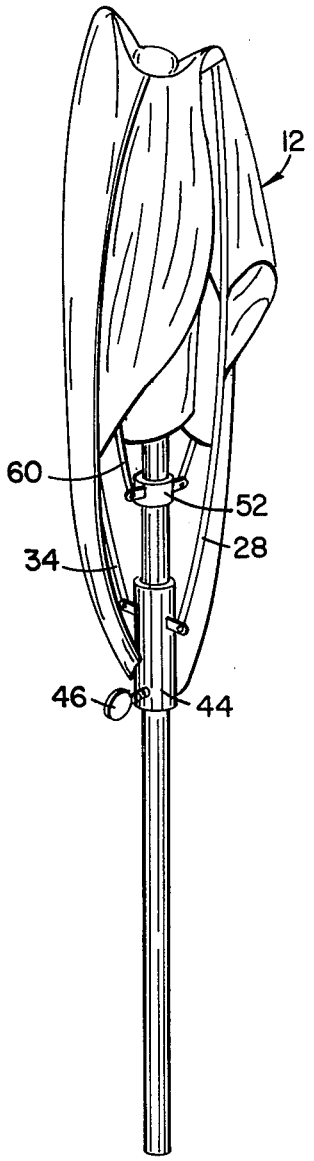
FIG. 3 is a view similar to FIG. 1 but illustrating the fully collapsed position of the shade structure.

It should thus be clear from the foregoing description and the drawings that to close or collapse the shade 12, the thumb screw 46 is loosened to release the slider 46 which can thereafter be slidably lowered. As the slider 44 lowers so does the second slider 52 which is supported thereon in the raised position. The lower ends of the ribs 28 and 34 lower with the slider 44 thereby pivoting the upper or pouch contained ends inwardly due to the constraint imposed by the struts 62 and 64. Moreover, as the upper slider 52 is lowered so too are the struts 58 and 60 which pull the ribs 30 and 32 downwardly about the pivot points at the ears 40, 42. As illustrated in FIG. 3 the slider 52 separates from the slider 44 prior to the latter being fully lowered when the rib ends of the struts 58 and 60 move adjacent the mast. To open the umbrella shade the slider 44 is raised to extend the ribs 28 and 34, raise the slider 52 and extend the other ribs and struts.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A lawn umbrella comprising a mast, a flexible shade having a generally quadrilateral configuration disposed above the mast, first and second ribs each having a bowed configuration between its ends, means for fastening one end of each of the first and second ribs to a respective corner of a first pair of opposed corners of the shade, means for pivotably mounting the other end of each of the first and second ribs to the mast adjacent the upper end for pivotable movement in a vertical plane and with the ribs bowed such that the center of curvature of each rib is beneath the shade, a first slider disposed about the mast and slidable relatively thereto, means for selectively locking said slider to said mast, third and fourth ribs each having a bowed configuration between its ends, means for fastening one end of each of the third and fourth ribs to a respective corner of a second pair of opposed corners of the shade, and means for pivotably mounting the other end of each of the third and fourth ribs to the slider for pivotable movement in a vertical plane and with the third and fourth ribs bowed such that the center of curvature of each said third and fourth rib is above the rib, whereby said shade may be collapsed by lowering said slider and opened by raising said slider.

2. A lawn umbrella as recited in claim 1, including a second slider disposed about said mast above said first slider, first and second struts, means for pivotably mounting one end of said first strut to said first rib for pivotable movement in a vertical plane, means for pivotably mounting one end of said second strut to said second rib for pivotable movement in a vertical plane, and means for mounting the other end of each of said first and second struts to said second slider.

3. A lawn umbrella as recited in claim 2, including third and fourth struts, means for pivotably mounting one end of said third strut to said third rib for pivotable movement in a vertical plane, means for pivotably mounting said fourth strut to said fourth rib for pivotable movement in a vertical plane, and means for pivotably mounting the other end of each of said third and fourth struts to said mast.

4. A lawn umbrella as recited in claim 3, wherein the means for fastening said one end of each of said ribs to said shade comprises a pouch formed at each corner of the shade for receiving the respective one end.

5. A lawn umbrella as recited in claim 3, wherein said other end of each of said third and fourth struts is mounted to said mast intermediate said second slider and said other end of each of the first and second ribs.

6. A lawn umbrella as recited in claim 3, wherein said first slider moves a greater distance relatively to said mast and then said second slider.

* * * * *